US009271547B2

(12) United States Patent
Terada et al.

(10) Patent No.: US 9,271,547 B2
(45) Date of Patent: Mar. 1, 2016

(54) MOLDED HOOK AND LOOP FASTENER

(75) Inventors: Mineto Terada, Toyama (JP); Shinichi Imai, Toyama (JP)

(73) Assignee: YKK Corporation (JP)

( * ) Notice: Subject to any disclaimer, the term of this patent is extended or adjusted under 35 U.S.C. 154(b) by 86 days.

(21) Appl. No.: 14/002,773

(22) PCT Filed: Mar. 7, 2011

(86) PCT No.: PCT/JP2011/055243

§ 371 (c)(1),
(2), (4) Date: Sep. 3, 2013

(87) PCT Pub. No.: WO2012/120618

PCT Pub. Date: Sep. 13, 2012

(65) Prior Publication Data

US 2013/0340214 A1 Dec. 26, 2013

(51) Int. Cl.
*A44B 18/00* (2006.01)

(52) U.S. Cl.
CPC ..... *A44B 18/0069* (2013.01); *A44B 18/0049* (2013.01); *A44B 18/0076* (2013.01); *Y10T 24/27* (2015.01); *Y10T 24/2725* (2015.01); *Y10T 24/2792* (2015.01)

(58) Field of Classification Search
CPC ..... A44B 18/0069; A44B 18/0049; A44B 18/0076; Y10T 24/2725; Y10T 24/27; Y10T 24/2708; Y10T 24/2717; Y10T 24/2792
USPC ..... 24/442, 443, 444, 446, 447, 448, 450, 24/452, 306
See application file for complete search history.

(56) References Cited

U.S. PATENT DOCUMENTS 6,656,563 B1 12/2003 Leach et al.
8,322,002 B2 * 12/2012 Cheng ..... 24/452
2005/0160534 A1 * 7/2005 Akeno et al. ..... 5/652

(Continued)

FOREIGN PATENT DOCUMENTS

GB 2468869 A 9/2010
JP 3-146003 A 6/1991
JP 2003-533314 A 11/2003

(Continued)

OTHER PUBLICATIONS

International Search Report, PCT Application No. PCT/JP2011/055243, mailed Jun. 7, 2011.

*Primary Examiner* — Robert J Sandy
*Assistant Examiner* — Michael Lee
(74) *Attorney, Agent, or Firm* — Kilpatrick Townsend & Stockton LLP

(57) ABSTRACT

The molded hook and loop fastener has multiple hook and loop fastener parts on which multiple engaging elements are disposed, and a connection member for connecting the hook and loop fastener parts. The hook and loop fastener parts have fixing parts which fix the connection member to backings. The backings have forward and rearward extensions that extend in the longitudinal direction from the positions where the fixing parts are disposed. The dimension in the longitudinal direction of the connection member at a connection part is set to be longer than the minimum interval between adjacent hook and loop fastener parts, thereby allowing the molded hook and loop fastener to be bent easily in the width direction, and allowing the forward and rearward extensions to prevent foam resin material from directly hitting lateral walls.

5 Claims, 6 Drawing Sheets

(56) References Cited

U.S. PATENT DOCUMENTS

| | | | | |
|---|---|---|---|---|
| 2007/0194611 | A1* | 8/2007 | Munoz Herrero et al. | 297/228.13 |
| 2010/0181695 | A1 | 7/2010 | Murasaki et al. | |

FOREIGN PATENT DOCUMENTS

| | | | |
|---|---|---|---|
| JP | 2006-205641 | A | 8/2006 |
| JP | 2010-162339 | A | 7/2010 |

* cited by examiner

MOLDED HOOK AND LOOP FASTENER

This application is a national stage application of PCT/JP2011/055243 which is incorporated herein by reference.

TECHNICAL FIELD

The invention relates to a molded hook and loop fastener which is integrated into a surface of a foam body when the foam body is molded, and particularly, relates to the molded hook and loop fastener which can prevent a molding resin material from intruding into an engaging element forming region of a substrate portion when performing a foam molding.

BACKGROUND ART

Seats for automobiles and trains, various sofas, office chairs, and the like, are provided with cushion bodies in the insides of their epidermis materials. For the cushion bodies, a molded body formed of material called rock wool and such, which is made by twisting stiff fibers, such as palm and hemp or thick synthetic fibers and hardening the same with a rubber and the like, and a molded body (foam body) which is formed of various foam resin materials are used.

These cushion bodies often have curved surfaces which are consisted of depression and projection form that is ergonomically satisfying so as to keep a sitting position which prevents fatigue from sitting for a long time. It is difficult to use the rock wool which requires many production processes for efficient mass production of the cushion body which has such a complicated surface form, by also considering its cushioning characteristic.

On the other hand, a foam resin cushion body is used broadly because the foam resin cushion body can be produced in a single process and various shapes can easily be obtained. Namely, the foam resin cushion body is molded in a desired form at the same time as foaming by pouring foam resin material such as, for example, foam urethane resin, into a mold.

Additionally, on the surface of the cushion body which has been molded in this manner, generally, epidermis material, such as various fiber fabric and natural or synthetic leather, is deposited. For depositing the epidermis material on the surface of the cushion body, either means for integrating the cushion body into the back surface of the epidermis material at the same time as molding of the cushion body by adsorbing the epidermis material along a cavity surface of the mold and by pouring the foam resin material into the mold, or means for molding the cushion body in a desired form and then covering the surface of the obtained cushion body with the epidermis material and fixing the same to the surface, is employed.

In the case of using the afore-mentioned means for integrating at the same time as molding, when setting the epidermis material along the inner surface of the mold, the epidermis material is adsorbed along the inner surface of the mold using suction means. However, in order to deform the epidermis material along the surface of the cushion body having a complicated surface form as mentioned above, the epidermis material itself needs to be good in elasticity. Nevertheless, for some materials, the elasticity has a limit. Therefore, when the surface form of the cushion body becomes complicated, numerous wrinkles tend to appear particularly between a seating surface and a peripheral side surface, and a lot of efforts are made to correct this.

Additionally, by the means, the cushion body and the epidermis material are integrated at the whole surface. Therefore, for example, if a strong force is applied in the direction that the epidermis material moves on the surface of the cushion body when being used, a shearing force works between the epidermis material and the cushion body, thereby possibly causing an abrasion of the epidermis material by tearing a part of the cushion body. Moreover, in order to prevent the afore-mentioned wrinkles from appearing, materials which may be used as the epidermis material are naturally limited, and it is preferred that a slight movement may be tolerated between the epidermis material and the cushion body so that an excessive force does not apply between the two. Therefore, a means for putting the epidermis material over the obtained cushion body after molding the cushion body in the desired form has become more frequently employed, rather than using a means for integrating the epidermis at the same time as the molding of the cushion body.

When putting the epidermis material over such cushion body which is made from the foam resin material, a method of using the molded hook and loop fastener which is made from a thermoplastic resin is generally employed. For example, firstly, the molded hook and loop fastener, which comprises multiple engaging elements (male engaging elements), is set on the cavity surface of the mold which molds the cushion body. At this point, the molded hook and loop fastener is mounted and fixed on a protruding surface portion of the mold bottom surface which corresponds to a recess surface of the cushion body with an engaging elements formation surface of the molded hook and loop fastener oriented toward the protruding surface portion.

Secondly, by pouring the foam resin material into the mold on which the molded hook and loop fastener is mounted so as to foam-mold the cushion body, at the same time as the molding of the cushion body, the molded hook and loop fastener is integrated into the recess surface of the cushion body with the engaging elements exposed outside. Note that, at the time of the foam-molding, it is important to prevent the foam resin material of the cushion body from flowing into a region where the engaging elements of the molded hook and loop fastener are formed.

Then, the epidermis material is put over the surface of the cushion body which has been obtained by the afore-mentioned foam-molding. The epidermis material is made from various materials such as pile woven and knitted fabrics, natural and synthetic leather, and synthetic leather and is previously formed into a bag in accordance with the external form of the cushion body. At this time, by pressing female engaging elements which are disposed on the back surface of the epidermis material against the engaging element forming region of the molded hook and loop fastener which is integrated into the cushion body so as to fasten the epidermis material to the molded hook and loop fastener along the recess surface of the cushion body, and therefore the epidermis material is prevented from coming off the cushion body.

As mentioned above, a molded hook and loop fastener that can prevent a foam resin material from intruding into an engaging element forming region when performing a foam-molding so as to integrate the molded hook and loop fastener into a cushion body is disclosed in JP 2010-162339 A (Patent Document 1), for example.

For example, as illustrated in FIG. 11, a molded hook and loop fastener 70 which is described in Patent Document 1 comprises multiple hook and loop fastener parts 71, each of which has an engaging element forming region 75 which is surrounded by a longitudinal protective wall 73 and a lateral protective wall 74 on the front and rear end edge sides, and a connection part 72 which establishes connection between the edges in the longitudinal direction of the adjacent hook and loop fastener parts 71 with a predetermined interval.

Each hook and loop fastener part 71 comprises a flat plate-shaped backing 76, multiple hook-shaped engaging elements (male engaging elements) 77 which are disposed to stand on the entire surface of the backing 76, left and right longitudinal protective walls 73 which are disposed to stand on left and right side edge portions of the backing 76 along the longitudinal direction so as to interpose the engaging elements 77 between them, a lateral protective wall 74 which is disposed to stand between the left and right longitudinal protective walls 73 along the width direction, a protruding portion 78 which fixes a monofilament composing the connection part 72, and a linear magnetic body 79 which is disposed along the longitudinal direction.

In addition, the front and rear end edges of each hook and loop fastener part 71 comprises a parallel portion 71a which is disposed parallel to each other between the hook and loop fastener parts 71 which are adjacent in the longitudinal direction, and inclined portions 71b which are disposed on both left and right sides of the parallel portion 71a. In this case, the parallel portion 71a has the same dimension in the width direction as the connection part (monofilament) 72.

Multiple engaging elements 77 which are disposed on each hook and loop fastener part 71 is aligned with predetermined intervals from each other along the longitudinal direction and the width direction of the backing 76.

The longitudinal protective wall 73 each has three rows of walls each on the left and right sides thereof, and the wall of each row are configured by multiple longitudinal walls 73a which are disposed at a predetermined pitch. In this case, between the walls of the adjacent rows, the longitudinal walls 73a are disposed in a staggered manner so as to be alternating with each other. Besides, the lateral protective wall 74 is configured by the engaging elements 77 which are aligned in the width direction and multiple lateral walls 74a which are disposed along the with direction.

The protruding portion 78 which fixes the monofilament is formed at a substantially central portion of the hook and loop fastener part 71 in the width direction, protruding from the backing 76 in a block shape, and buries the monofilament all through the region of the hook and loop fastener part 71. The linear magnetic body 79 which is disposed on the hook and loop fastener part 71 is fixed by a portion of the same being buried in a fixing part 80 which protrudes in the block shape from the backing 76.

As described above, the connection part 72 which establishes connection between the hook and loop fastener parts 71 is formed of a synthetic resin linear monofilament which is buried in the protruding portion 78 of each hook and loop fastener part 71. While the monofilament is buried in the protruding portion 78 in the region of the hook and loop fastener part 71, the monofilament is exposed outside between the adjacent hook and loop fastener parts 71, and the connection part 72 is formed of the exposed portion of the monofilament. To dispose such connection part 72 enables the molded hook and loop fastener 70 to be bent easily in the width direction.

When producing the molded hook and loop fastener of Patent Document 1 having the configuration as mentioned above, firstly, a continuous long hook and loop fastener member (hereafter referred to as a "primary hook and loop fastener member") which has not yet been cut into multiple hook and loop fastener parts 71 is produced. The primary hook and loop fastener member is produced by means of a production device including a die wheel which is driven rotationally, an extruding nozzle which supplies molten resin to the circumferential surface of the die wheel, and a supply portion which supplies the monofilament and the linear magnetic body 79 from an upstream position of a position where the molten resin for the die wheel is supplied. In this case, on the circumferential surface of the die wheel, cavities for molding the engaging elements 77 and cavities for molding the longitudinal wall 73a and the lateral wall 74a and such are formed.

After producing the long primary hook and loop fastener member by means of such a production device, a portion of the obtained primary hook and loop fastener member is cut off at any point all through the width direction so as to preserve the monofilament which forms the connection part 72. In this way, the molded hook and loop fastener 70 of Patent Document 1 as illustrated in FIG. 11 is produced.

The molded hook and loop fastener 70 of Patent Document 1 obtained in this way is adsorbed and fixed on the cavity surface of the mold so as to make the engaging elements 77 opposed to the cavity surface by using magnetic force of a magnet which is previously installed at the mold for molding, when performing a foam molding of the cushion body.

At this time, in the molded hook and loop fastener 70, the connection part 72 (monofilament) which establishes connection between the hook and loop fastener parts 71 can be easily bent. Therefore, for example, even if a portion of the mold for fixing the molded hook and loop fastener 70 (protruding surface portion) is curved, it becomes possible to adsorb and fix the molded hook and loop fastener 70 stably to the cavity surface of the mold with the molded hook and loop fastener 70 curved in the width direction.

Additionally, as for the molded hook and loop fastener 70, the engaging element forming region 75, on which multiple engaging elements 77 are disposed, is surrounded by the longitudinal protective wall 73 and the lateral protective wall 74. Therefore, when performing a foam molding of the cushion body, the foam resin material can be prevented from intruding into the engaging element forming region 75 over the longitudinal protective wall 73 and the lateral protective wall 74. Accordingly, even after the cushion body is foam-molded, a fastening force by the engaging elements 77 can be obtained in the engaging element forming region 75 of the molded hook and loop fastener 70. Therefore, when putting the epidermis material over the cushion body, the back surface of the epidermis material can be stably fastened on the molded hook and loop fastener 70.

PRIOR ART DOCUMENT

Patent Document

Patent Document 1: JP 2010-162339 A

DISCLOSURE OF THE INVENTION

Problem to be Solved by the Invention

As mentioned above, the molded hook and loop fastener 70 of Patent Document 1 connects multiple hook and loop fastener parts 71 with the connection part 72 which is consisted of the monofilament, and the molded hook and loop fastener 70 can be bent easily in the width direction by bending the connection part 72. However, in recent years, to adapt to various forms of cushion bodies, improvement of the molded hook and loop fastener 70 so as to be bent at a larger curvature is required.

Additionally, in order to form the connection part 72, the molded hook and loop fastener 70 of Patent Document 1 is produced, by cutting off a part of the primary hook and loop fastener member at any suitable position along the width direction after molding the long primary hook and loop fastener member, as mentioned above.

However, as illustrated in FIG. 11, as for the molded hook and loop fastener 70 which is produced in this manner, a portion of the same which is cut off at the time of manufacture happens to lap over the position of the lateral protective wall 74. In this case, a part of the lateral protective wall 74 which is disposed on the end edge side of the hook and loop fastener part 71 (the front end edge side of the hook and loop fastener part 71 in FIG. 11) is also cut off at the same time.

If a part of the lateral protective wall 74 is cut off like this, when performing a foam molding of the cushion body by integrating the molded hook and loop fastener 70 into the same, the foam resin material crosses over the cut lateral protective wall 74 and intrudes into an arrangement position of the next lateral protective wall 74 along the longitudinal direction of the hook and loop fastener part 71. As a result, the effective engaging element forming region 75 of the hook and loop fastener part 71 becomes smaller, therefore the predetermined desired fastening force may sometimes not be stably obtained.

Moreover, in Patent Document 1, the primary hook and loop fastener member is cut off at any suitable position so as to produce the molded hook and loop fastener 70. Thus, even if the portion which is cut off at the time of manufacture does not lap over the position of the lateral protective wall 74, for example when it is cut off at a neighboring position of the lateral protective wall 74, the lateral protective wall 74 is disposed at the position close to the end edge of the hook and loop fastener part 71 (the rear end edge of the hook and loop fastener part 71 in FIG. 11).

In a case that the lateral protective wall 74 is disposed close to the end edge of the hook and loop fastener part 71 as stated above, for example in foam molding of the cushion body, when spraying the foam resin material from a spray nozzle by moving the spray nozzle relatively with respect to the mold, the foam resin material happens to be sprayed in the direction which is inclined with respect to the perpendicular direction. In this case, the sprayed foam resin material easily hits the lateral protective wall 74 (particularly, the lateral wall 74a) directly.

However, when the foam resin material directly hits the lateral protective wall 74, the foam resin material, which receives pressure by the spray, vigorously hits the lateral protective wall 74. This makes the foam resin material easily intrude into the engaging element forming region 75 crossing over the lateral protective wall 74 from a gap and such which is formed in the lateral protective wall 74, causing reduction in fastening force of the molded hook and loop fastener 70, and therefore there has been a room for improvement.

The invention has been made in view of the above-mentioned conventional problem, and its specific objective is to provide a molded hook and loop fastener which can be bent in the width direction at ever-larger curvature when being adsorbed and fixed to the cavity surface of the mold for foam molding, effectively prevents the foam resin material from intruding into the engaging element forming region in foam molding of the foam body, and can stably ensure fastening force with other members such as the epidermis material.

Means for Solving the Problems

In order to achieve the above-mentioned objectives, the molded hook and loop fastener provided by the invention comprises, as a basic configuration, multiple hook and loop fastener parts having backings whose first surfaces are provided with multiple engaging elements so as to stand on the first surfaces; and a connection member which has flexibility and connects the hook and loop fastener parts in a longitudinal direction, the molded hook and loop fastener being integrated into a surface of a foam body when the foam body is molded, characterized in that the hook and loop fastener parts comprise fixing parts which fix the connection member to the first surfaces or second surfaces of the backings, the backings of all of the hook and loop fastener parts comprise forward and rearward extensions which extend in the longitudinal direction from positions where the fixing parts are disposed, and from which the engaging elements are excluded, and a dimension in the longitudinal direction of the connection member at a connection part which is disposed between the fixing parts and connects the hook and loop fastener parts, is set to be longer than a minimum interval between adjacent hook and loop fastener parts.

In the molded hook and loop fastener according to the invention, it is preferred that the hook and loop fastener part comprises left and right longitudinal protective walls which are disposed along the longitudinal direction of the backing so as to interpose the multiple engaging elements between them, and lateral protective walls which are disposed between the left and right longitudinal protective walls, and the fixing parts are disposed at the lateral protective walls.

In this case, it is especially preferred that the engaging elements are disposed to stand on the backing so as to be aligned in the longitudinal direction and a width direction of the backing, and multiple lateral walls, which configure the lateral protective walls together with the engaging elements aligned in the width direction, are disposed to stand along the width direction between the left and right longitudinal protective walls.

Moreover, in the molded hook and loop fastener according to the invention, it is preferred that each of dimensions in the longitudinal direction from a front end edge and a rear end edge of the forward and rearward extensions to the lateral walls are set to be 50% or more of a dimension of the engaging element in the longitudinal direction.

Further, it is preferred that the connection member is configured by being bent in a width direction of the backing into a zig-zag shape, and comprises at least two bent portions at the connection part.

Moreover, it is preferred that the connection member has a lateral cross section of an elliptical shape whose major axis is orientated along a front and rear direction of the backing.

Furthermore, in the molded hook and loop fastener according to the invention, it is preferred that opposed end edges of adjacent hook and loop fastener parts comprise parallel portions which are disposed so as to be parallel to each other, and inclined portions which are disposed on both left and right sides of the parallel portions so that an interval between the hook and loop fastener parts is gradually increased toward side end edges of the hook and loop fastener parts, and a width dimension of the parallel portion is set to be larger than a width dimension of the connection part.

Effect of the Invention

In the molded hook and loop fastener according to the invention, each of the hook and loop fastener parts comprises the backing on which the multiple engaging elements are disposed to stand thereon, the fixing parts which fix the connection member to the backing, and the forward and rearward extensions which extend in the longitudinal direction of the backing from the positions where the fixing parts are disposed, and from which the engaging elements are excluded.

Moreover, the dimension in the longitudinal direction of the connection member at the connection part, which is disposed between the fixing parts, and connects the hook and loop fastener parts to each other, is set to be longer than the minimum interval between adjacent hook and loop fastener parts.

For example, in the molded hook and loop fastener of above-mentioned Patent Document 1, the longitudinal dimension of the connection part, which is disposed between the fixing parts of the connection member, is the same as the minimum interval between the adjacent hook and loop fasteners, and therefore the dimension (curvature) in which the molded hook and loop fastener is bent in the width direction is restricted by the length of the interval between the hook and loop fastener parts.

On the other hand, for example, by disposing the fixing parts which are disposed at the hook and loop fastener part inward with respect to the positions of the front end edge of the forward extension side and the rear end edge of the rearward extension side, and by setting the longitudinal dimension of the connection part which is disposed between the fixing parts of the connection member to be longer than the minimum interval between the adjacent hook and loop fastener parts like the present invention, the molded hook and loop fastener can be bent more easily in the width direction. Moreover, the dimension (curvature) in which the molded hook and loop fastener is bent, can be increased more easily than before without being restricted by the length of the interval between the hook and loop fastener parts.

By the way, for example, in a conventional mold for foam molding, when performing a foam molding in a state where a molded hook and loop fastener is set on a cavity surface, in order to prevent a foam resin material from intruding into the region of the molded hook and loop fastener where the engaging elements are disposed, a wall may be disposed to stand with a predetermined height at the portion of the cavity surface on which the molded hook and loop fastener is set so as to enclose the engaging elements.

For such mold whose cavity surface is provided with the wall to stand, a molded hook and loop fastener according to the invention having a mode which comprises the above-mentioned forward and rearward extensions, but does not comprise a longitudinal protective wall and a lateral protective wall as will be described later, can be used. In this case, even when the foam resin material is sprayed obliquely with respect to the vertical direction when performing a foam molding of a foam body, the forward and rearward extensions act as eaves so that the direct impact of the foam resin material on the wall of the mold can be effectively prevented. With this, for example, even in a case where a gap is provided at the wall of the mold, the foam resin material can be prevented from passing over the wall and intruding into the engaging element forming region, and therefore the fastening force of the engaging element forming region can be stably ensured.

In such molded hook and loop fastener of the invention, each hook and loop fastener part comprises left and right longitudinal protective walls which are disposed to stand along the longitudinal direction of the backing so as to interpose the multiple engaging elements between them, and lateral protective walls which are disposed between the left and right longitudinal protective walls, and the fixing parts are disposed at the lateral protective walls.

With this, the longitudinal dimension of the connection part between the fixing parts can surely be made longer than the minimum interval between the adjacent hook and loop fastener parts. Moreover, since the forward and rearward extensions are formed to extend in the longitudinal direction from the positions where the lateral protective walls are disposed, for example, even when the foam resin material is sprayed obliquely with respect to the vertical direction when performing a foam molding of a foam body, the forward and rearward extensions act as eaves against the lateral protective wall so that the direct impact of the foam resin material on the lateral protective wall can be effectively prevented. Accordingly, the foam resin material can stably be prevented from passing over the lateral protective wall and intruding into the region of the hook and loop fastener part where the engaging elements are formed, and therefore the fastening force of the engaging element forming region can be stably ensured.

Note that, in this case, the extension length of each of the hook and loop fastener parts of the forward and rearward extensions is set to be shorter than the attachment pitch of the lateral protective wall in the longitudinal direction. With this, in each of the hook and loop fastener parts, the effective engaging element forming region that prevent the foam resin material from intruding into the region can be ensured with an appropriate dimension (area) and therefore the predetermined desired fastening force can be stably obtained.

Particularly, in this case, the engaging elements are disposed to stand on the backing so as to be aligned in the longitudinal direction and the width direction of the backing, and the multiple lateral walls, which constitute the lateral protective walls together with the engaging elements aligned in the width direction, are disposed to stand along the width direction between the left and right longitudinal protective walls. With this, the lateral protective walls are surely disposed at the respective hook and loop fastener parts so that the foam resin material is stably prevented from intruding into the engaging element forming region when performing a foam molding of the foam body by the lateral protective walls. Moreover, the area of the engaging element forming region, which is formed by being enclosed with the lateral protective walls disposed on the far forward side and the far rearward side of each of the hook and loop fastener parts, and the left and right longitudinal protective walls, can be effectively ensured.

Moreover, in the molded hook and loop fastener of the invention, the dimensions in the longitudinal direction from the front end edge and the rear end edge of the forward and rearward extensions to the lateral walls are set to be 50% or more of the dimension of the engaging element in the longitudinal direction, and therefore the forward and rearward extensions effectively act as eaves so that the direct impact of the foam resin material (especially on the lateral wall) can be surely prevented.

Further, in the molded hook and loop fastener of the invention, the above-mentioned connection member is configured by being bent in the width direction of the backing into a zig-zag shape, and comprises at least two bent portions at the connection part which is disposed between the fixing parts of the adjacent hook and loop fastener parts. With this, the connection part of the connection member can be configured so as to be bent more easily in the width direction. Therefore, when the molded hook and loop fastener is fixed to the mold in a state of being bent, it becomes possible to easily bend the molded hook and loop fastener and to stably fix it to the mold.

Furthermore, in the invention, the above-mentioned connection member has the lateral cross section of the elliptical shape whose major axis is orientated along the front and rear direction of the backing. Also with this, the connection member can be configured to be more easily bent in the width direction.

Moreover, in the molded hook and loop fastener of the invention, the opposed end edges of the adjacent hook and loop fastener parts comprise parallel portions which are disposed so as to be parallel to each other, and inclined portions which are disposed on both left and right sides of the parallel portions so that an interval between the hook and loop fastener parts is gradually increased toward side end edges of the hook and loop fastener parts, and a width dimension of the parallel portion is set to be larger than a width dimension of the connection part.

Since the inclined portions are disposed at the opposed end edges of the hook and loop fastener parts like this, when the molded hook and loop fastener is bent in the width direction, the adjacent hook and loop fasteners are prevented from interfering with each other. Moreover, the width dimension of the parallel portion of the hook and loop fastener part is made larger than the width dimension of the connection part, and therefore the longitudinal dimensions of the forward and rearward extensions and the area of the effective engagement element forming region can be efficiently ensured.

MODE(S) FOR CARRYING OUT THE INVENTION

A preferred embodiment of the invention will be described in detail with reference to the drawings hereunder. Note that, the invention is not limited to the embodiment described below at all, and various modifications can be made as long as they have substantially the same configurations, and perform similar functions and effects. For example, although the molded hook and loop fastener of the embodiment described below comprises a longitudinal protective wall and a lateral protective wall, the molded hook and loop fastener of the invention comprises, for example, a molded hook and loop fastener which is not provided with the longitudinal protective wall and the lateral protective wall as long as a connection member and forward and rearward extensions are disposed under a predetermined condition.

Figure 1:
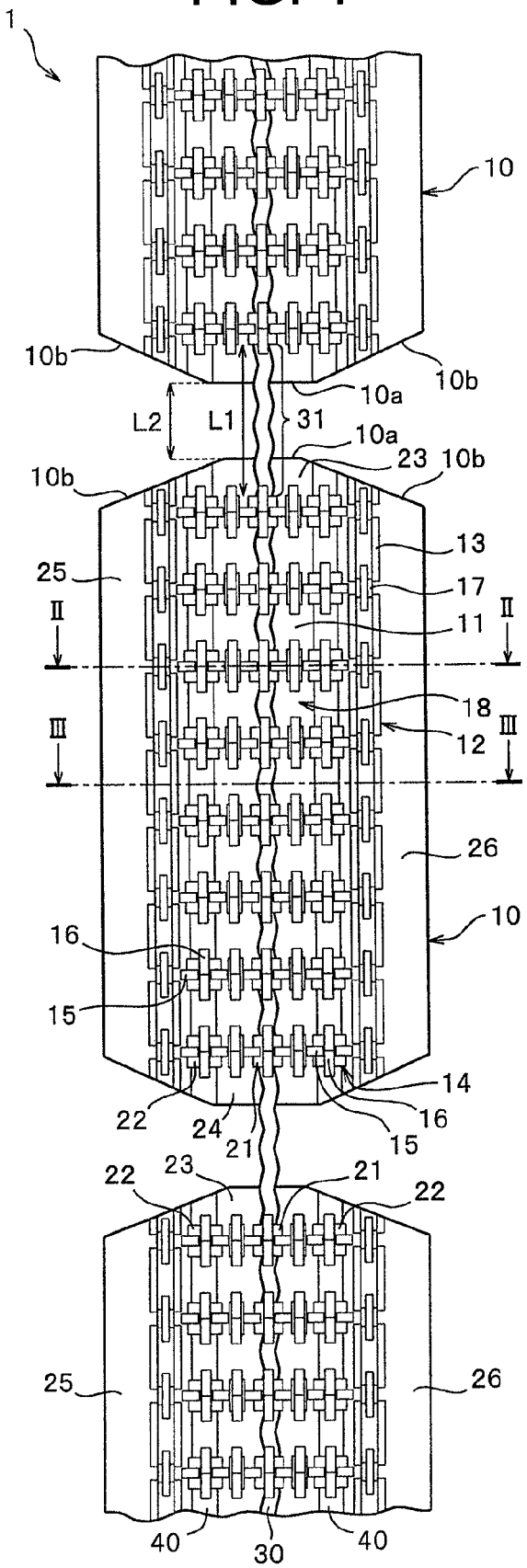
FIG. 1 is a front view illustrating a molded hook and loop fastener according to an embodiment of the invention.
Figure 2:
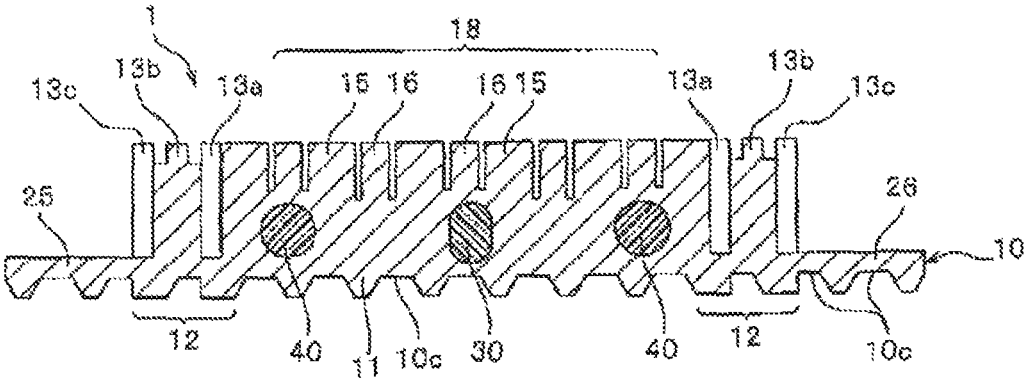
FIG. 2 is a cross sectional view along the II-II line in FIG. 1.
Figure 3:
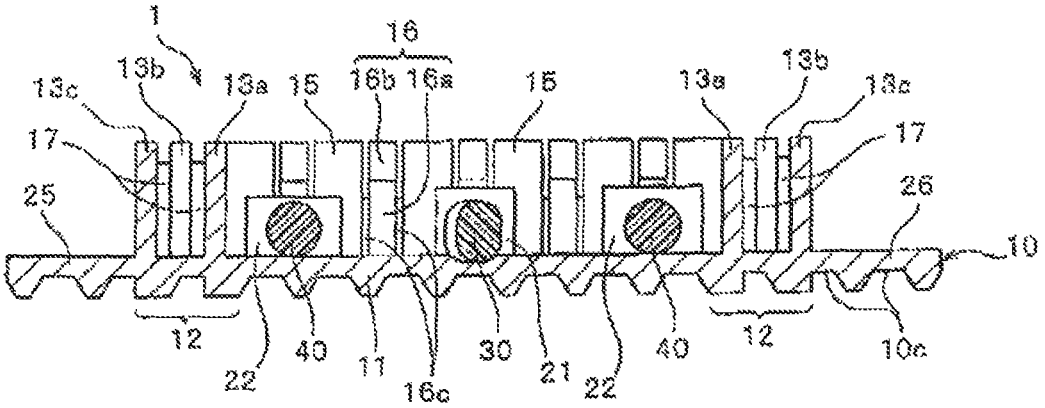
FIG. 3 is a cross sectional view along the line in FIG. 1.

FIG. 1 is a front view illustrating a molded hook and loop fastener according to the embodiment. Moreover, FIG. 2 is a cross sectional view along the II-II line in FIG. 1, and FIG. 3 is a cross sectional view along the line in FIG. 1.

Note that, in the following descriptions, the longitudinal direction in the backing of the molded hook and loop fastener is defined as a front and rear direction, and the width direction in the backing is defined as a left and right direction. Moreover, the front and back direction in the backing is defined as a vertical direction. Particularly, the direction on the side where engaging elements are disposed with respect to the backing is defined as upward, and the direction on its opposite side is defined as downward.

A molded hook and loop fastener 1 according to the embodiment comprises multiple hook and loop fastener parts 10 including flat plate-shaped backings 11, each of which has an upper surface (first surface) on which multiple engaging elements 16 are disposed to stand, a monofilament 30 which forms connection members for connecting adjacent hook and loop fastener parts 10 to each other in the front and rear direction, and linear magnetic bodies 40 which are fixed to each molded hook and loop fastener 1 along the front and rear direction.

Each of the hook and loop fastener parts 10 in this molded hook and loop fastener 1 is formed, as described later, by molding a thermoplastic resin material by using a die wheel. Note that, as the material for the hook and loop fastener parts 10, thermoplastic resin materials, such as polyethylene, polypropylene, polyester, nylon, polybutylene terephthalate, or copolymers of the same, may be adopted.

In the molded hook and loop fastener 1, each hook and loop fastener part 10 has a substantially octagonal shape which is long in the front and rear direction (longitudinal direction) when seen from the front. In this case, the left and right side end edges of each hook and loop fastener part 10 are formed along the longitudinal direction of the hook and loop fastener part 10 so as to be parallel to each other.

Moreover, each hook and loop fastener part 10 is provided with, at its front and rear end edges, parallel portions 10*a* which are disposed in parallel between adjacent hook and loop fastener parts 10, and inclined portions 10*b* which gradually increase the interval between the hook and loop fastener parts 10 toward the left and right side end edge sides. Since the inclined portions 10*b* are disposed at the front and rear end edges of the hook and loop fastener parts 10, when the molded hook and loop fastener 1 is bent in the left and right width direction (refer to FIG. 7 and FIG. 8), it is possible to make it difficult for the hook and loop fastener parts 10 to interfere with each other.

In the embodiment, each hook and loop fastener part 10 comprises the flat plate-shaped backing 11, left and right longitudinal protective walls 12 which are disposed to stand on the upper surface of the backing 11, multiple engaging elements 16 (male engaging elements) which are disposed between the left and right longitudinal protective walls 12, multiple lateral walls 15 which constitute lateral protective walls 14 together with the engaging elements 16, first fixing parts 21 for fixing the monofilament 30, and second fixing parts 22 for fixing the linear magnetic bodies 40, respectively.

The backing 11 in the embodiment is formed by a thin plate in order to enable the molded hook and loop fastener 1 to be bent in the vertical direction. The region in the upper surface of this backing 11 where neither the longitudinal protective wall 12 nor the lateral protective wall 14 is disposed is formed in a flat surface. On the other hand, on the lower surface side of the backing 11, multiple recess groove portions 10*c* (or protruding portions) are formed so as to be disposed in parallel to each other in the front and rear direction in order to enlarge the junction area between the molded hook and loop fastener 1 and a foam body (cushion body 5) described later when the molded hook and loop fastener 1 is integrally molded into the foam body, and enhance the fixing strength.

Note that, in the invention, in order to enhance the fixing strength between the molded hook and loop fastener 1 and the foam body, for example, the lower surface of the backing 11 may be provided with a protruding portion having an arrowhead shape, or a non-woven fabric or a resin molded body, such as a foamed polyurethane, may be adhered to or fixed to the lower surface of the backing 11. Further, when a non-woven fabric or a resin molded body is adhered to or fixed to the lower surface side of the backing 11, as described later, in order to assist the effect of preventing the foam resin material from intruding into the engaging element forming region 18 of the hook and loop fastener part 10 when performing a foam molding of the foam body by means of the longitudinal protective walls 12 and the lateral protective walls 14, the non-woven fabric or the resin molded body may be formed so as to be larger than the hook and loop fastener part 10 in the front and rear direction and the left and right direction, and adhered to or fixed to the lower surface of the backing 11.

The left and right longitudinal protective walls 12 are disposed to stand along the front and rear direction so as to interpose the plurality of engaging elements 16 between them, and are positioned slightly inward from the left and right side edges of the backing 11 (end edges of left and right extensions 25, 26). Each of these left and right longitudinal protective walls 12 comprises walls of three rows, and the wall of each row is configured by multiple longitudinal walls 13 which are disposed at a predetermined pitch in the longitudinal direction. Moreover, at the longitudinal protective walls 12, linkage portions 17 for linking together the longitudinal walls 13 disposed in adjacent rows are disposed.

Here, the longitudinal walls 13 of the row of the longitudinal protective walls 12, which is disposed at the side closest to the engaging elements 16, are defined as first row longitudinal walls 13*a*. The longitudinal walls 13 of the row, which is disposed outside the first row longitudinal walls 13*a*, are defined as second row longitudinal walls 13*b*. The longitudinal walls 13 of the row, which is disposed at the outermost side, are defined as third row longitudinal walls 13*c*. Note that, in the invention, the mode or the number of arrangement (row numbers) of the longitudinal walls constituting the longitudinal protective walls 12 is not specifically limited.

The longitudinal walls 13 of each row are intermittently disposed at a predetermined attachment pitch in the longitudinal direction, and predetermined spaces are left between the longitudinal walls 13. In the embodiment, the longitudinal walls 13*a* to 13*c* of the first to third rows are disposed in a staggered manner so as to take positions of alternating with each other between the rows. In this case, between the first row longitudinal walls 13*a* and the third row longitudinal walls 13*c*, the dimensions and arrangement positions of the longitudinal walls 13, and the dimensions of spaces between the longitudinal walls 13 are set to be the same.

The second row longitudinal walls 13*b* are disposed so as to correspond to the spaces which are formed between the first and third row longitudinal walls 13*a*, 13*c*. Moreover, although the dimension in the vertical direction of the second row longitudinal walls 13*b* (height dimension from the upper surface of the backing 11) is set to be the same as those of the first and third row longitudinal walls 13*a*, 13*c*, the dimension in the front and rear direction (longitudinal dimension) is set to be shorter than those of the first and third row longitudinal walls 13*a*, 13*c*.

The linkage portions 17 of the longitudinal protective walls 12 are disposed between the first and third row longitudinal walls 13*a*, 13*c* and the second row longitudinal walls 13*b*, and link the front end portions and the rear end portions of the first and third row longitudinal walls 13*a*, 13*c* and the central portions in the longitudinal direction of the second row longitudinal walls 13*b*. The height dimension of this linkage portion 17 is set to be lower than those of the first to third row longitudinal walls 13*a* to 13*c*, and the dimension in the left and right direction (width dimension) is set to be substantially the same as the spaces in the width direction between the first and third row longitudinal walls 13*a*, 13*c* and the second row longitudinal walls 13*b*.

The longitudinal protective walls 12 of the embodiment are configured as mentioned above, and therefore, when performing a foam molding of the foam body (cushion body 5), the foam resin material is effectively prevented from crossing over the longitudinal protective walls 12 so as to intrude inward into the engaging element forming region 18 side. Moreover, at the longitudinal protective walls 12, by widening or narrowing the spaces disposed between the longitudinal walls 13 of respective rows, the molded hook and loop fastener 1 can be bent in the vertical direction.

The engaging elements 16 disposed to stand on the backing 11 of each hook and loop fastener part 10 are disposed so as to be aligned at a predetermined attachment pitch in the longitudinal direction and the width direction in order to obtain a fastening force with respect to the epidermis material which is covered on the foam body (cushion body 5). Particularly, in the case of the embodiment, between the left and right longitudinal protective walls 12, the engaging elements 16 are disposed so as to be set in five rows in the width direction. The engaging element forming region 18 of each hook and loop fastener part 10 is formed by being enclosed with the left and right longitudinal protective walls 12, the lateral protective wall 14 disposed on the far forward side, and the lateral protective wall 14 disposed on the far rearward side.

Moreover, each engaging element 16 comprises a rising portion 16*a* which rises vertically from the upper surface of the backing 11, and a hook-shaped engaging head portion 16*b* which diverges in the front and rear direction at the upper end of the rising portion 16*a* and curves. Further, the height dimension of each engaging element 16 from the upper surface of the backing 11 is set to be the same as that of the longitudinal wall 13 which constitutes the longitudinal protective wall 12. Note that, in the invention, the shapes, dimensions, attachment pitches and the like, are not specifically limited, and can be optionally changed.

Further, in the embodiment, the engaging elements 16, which are disposed at the second row and the fourth row in the longitudinal direction from the left longitudinal protective wall 12, comprise reinforcement portions 16*c* which are linked with the lateral walls 15 adjacent to the concerned engaging elements 16. The reinforcement portions 16*c* are disposed at the left and right side surfaces of the rising portions 16*a* of the engaging elements 16, and the height dimension of the reinforcement portion 16*c* in the vertical direction is set to be lower than those of the engaging element 16 and the lateral wall 15.

The lateral walls 15 of the embodiment are disposed to stand along the width direction between the second row longitudinal walls 13 in the longitudinal protective walls 12 and the engaging elements 16, and between the engaging elements 16 which are adjacent to each other in the width direction, and constitute the lateral protective walls 14 together with the engaging elements 16 which are aligned in the width direction. In this case, each lateral wall 15 is linked with the engaging element 16, which is disposed next to one another, at the lower end portion (end portion on the backing 11 side) (refer to FIG. 2), and therefore the lateral wall 15 and the engaging element 16 are reinforced with each other.

Moreover, the height dimension of each lateral wall 15 from the upper surface of the backing 11 is set to be the same as the height dimension of the longitudinal wall 13 and the height dimension of the engaging element 16. Namely, in the embodiment, as illustrated in FIG. 1 and FIG. 2, all of the height dimensions of the longitudinal wall 13, the lateral wall 15, and the engaging element 16 are set to be the same, and their upper surfaces are disposed at the same plane. Therefore, as described later, when performing a foam molding of the foam body, the molded hook and loop fastener 1 can be stably adhered to the flat cavity surface of the mold, thereby effectively preventing the foam resin material from crossing over the longitudinal protective walls 12 and the lateral protective walls 14 so as to intrude into the engaging element forming region 18.

Note that, although the lateral wall 15 and the engaging element 16 are linked with each other at the lower end portions as described above, they are disposed to be spaced apart from each other with a small space at the upper end portions. Although the lateral wall 15 and the engaging element 16 are spaced apart from each other at the upper end portions like this, since the space of being spaced apart is very small, when performing a foam molding of the foam body, the foam resin material does not intrude into the engaging element forming region 18 through the space between the lateral wall 15 and the engaging element 16.

Moreover, in the invention, the lateral protective wall may be configured as a single continuous wall by integrally linking together the engaging element and the lateral wall at their portions near the upper ends. Further, the lateral protective wall may be configured only by the lateral walls without using the engaging elements at the position which is different in the longitudinal direction from the position of the engaging elements aligned along the width direction. Also in this case, it is preferred that the first fixing part for fixing the monofilament is configured integrally with the lateral protective portion (lateral wall) as described later.

In each hook and loop fastener part 10, the first fixing part 21 for fixing the monofilament 30 is formed so as to protrude in a block shape from the backing 11 at the substantially central portion in the width direction of the hook and loop fastener part 10, and the monofilament 30 is buried in the first fixing part 21 at a predetermined interval such that the monofilament 30 passes through the first fixing part 21. In this case, the first fixing parts 21 are disposed at the lateral protective wall 14 in a form of block shape, and disposed at a predetermined pitch along the front and rear direction. Particularly, the first fixing part 21 of the embodiment is configured integrally with the engaging element 16 and the lateral wall 15 which constitute the lateral protective wall 14.

Note that, in the invention, for example, when the molded hook and loop fastener 1 has been molded, ribs or rib-shaped burrs, which support the monofilament 30 at its left and right sides, happen to be formed on both the left and right sides of the monofilament 30. However, such ribs and burrs are thinly formed in the width direction so that they can be elastically deformed easily, and therefore the ribs and burrs are not comprised in the fixing parts which fix the monofilament.

Moreover, in each hook and loop fastener parts 10, the second fixing part 22 for fixing the linear magnetic body 40 is formed to protrude in a block shape from the backing 11 close to the inside with respect to the longitudinal protective wall 12. The linear magnetic body 40 is buried in the second fixing parts 22 at a predetermined interval such that the linear magnetic body 40 passes through the second fixing parts 22. Moreover, similar to the first fixing part 21, the second fixing part 22 is configured integrally with the engaging element 16 and the lateral wall 15 which constitute the lateral protective wall 14, and the second fixing parts 22 are disposed at a predetermined pitch along the front and rear direction.

Note that, in the invention, the first fixing parts for fixing the monofilament and the second fixing parts for fixing the linear magnetic bodies may be configured separately from the lateral protective walls (lateral walls), further, the first fixing parts and the second fixing parts may be disposed on the lower surface side of the backing so that the monofilament and the linear magnetic bodies may be fixed on the lower surface side of the backing.

In all of the hook and loop fastener parts 10 of the embodiment, the backing 11 comprises forward and rearward extensions 23, 24 which are disposed at the front and rear end edge portions of the hook and loop fastener part 10, and the left and right extensions 25, 25 which are disposed outside the longitudinal protective walls 12. The engaging elements 16 are excluded from these forward and rearward extensions 23, 24 and the left and right extensions 25, 26 so as to provide a region where no engaging element 16 exists.

The forward and rearward extensions 23, 24 extend forward and rearward from the arrangement positions of the lateral walls 15 and the first fixing parts 21 between the left and right longitudinal protective walls 12. The minimum value of the extension length in the front and rear direction from the lateral walls 15 at the forward and rearward extensions 23, 24, namely, the minimum value of the longitudinal dimension from the lateral walls 15 which are disposed at the far forward and rearward positions of each hook and loop fastener part 10 to the front end edge and the rear end edge of the forward and rearward extensions 23, 24, is set to be 50% or more of the dimension in the longitudinal direction of the engaging element 16 (namely, the longitudinal dimension of the engaging head portion 16*b*). Here, the minimum value of the extension length of the forward and rearward extensions 23, 24 is the extension length of the forward and rearward extensions 23, 24 at the positions which are closer to the left and right longitudinal protective walls 12 because the inclined portions 10*b* are disposed at each hook and loop fastener part 10 as mentioned above.

Moreover, the maximum value of the extension length of the forward and rearward extensions 23, 24 is set to be shorter than the attachment pitch of the lateral protective wall 14 in the longitudinal direction, preferably, is set to be shorter than the space between the lateral walls 15 which are adjacent to each other in the longitudinal direction. Here, the maximum value of the extension length of the forward and rearward extensions 23, 24 is the extension length of the forward and rearward extensions 23, 24 at the central portion region in the width direction where the parallel portions 10*a* of each hook and loop fastener part 10 are disposed.

The maximum value of the extension length of the forward and rearward extensions 23, 24 is set within the above-mentioned range, and therefore, when the molded hook and loop fastener 1 is manufactured, the forward and rearward extensions 23, 24 where the engaging elements 16 are not disposed can be surely formed, and further, when the molded hook and loop fastener 1 is bent in the left and right direction at a connection part 31, it is possible to make it difficult for adjacent hook and loop fastener parts 10 to interfere with each other.

On the other hand, the left extension 25 and the right extension 26 are disposed outside the left and right longitudinal protective walls 12 of the hook and loop fastener part 10. These left and right extensions 25, 26 are disposed to extend outward in the left and right direction from the arrangement positions of the third row longitudinal walls 13*c*. The extension length in the width direction from the longitudinal walls 13 at the left and right extensions 25, 26 is set to be larger than the minimum value of the extension length at the above-mentioned forward and rearward extensions 23, 24.

Since such forward and rearward extensions 23, 24 and the left and right extensions 25, 26 are disposed at the backings 11 of all of the hook and loop fasteners 10, when the foam body is foam-molded, the respective extensions 23 to 26 act as eaves against the sprayed foam resin material so that the foam resin material is prevented from directly hitting the lateral protective wall 14 and the longitudinal protective wall 12.

Particularly, in the embodiment, the extension length at the forward and rearward extensions 23, 24 is set to be 50% or more of the longitudinal dimension of the engaging element 16, and therefore the front end edge of the forward extension 23 and the rear end edge of the rearward extension 24 are not disposed at regions which are positioned at the inside with respect to the engaging head portion 16*b* of the engaging element 16. Therefore, the foam resin material, which is sprayed toward the molded hook and loop fastener 1, can be effectively prevented from directly hitting the lateral walls 15 which constitute the lateral protective walls 14. Moreover, the forward and rearward extensions 23, 24 and the left and right extensions 25, 26 are buried within the foam body when foam-molding the foam, and therefore an effect of enhancing the fixing strength of the molded hook and loop fastener 1 with respect to the foam can be obtained.

Note that, in the embodiment, the forward and rearward extensions 23, 24 and the left and right extensions 25, 26 are comprised in the backing 11, and therefore the upper surfaces of the forward and rearward extensions 23, 24 and the upper surfaces of the left and right extensions 25, 26 are disposed at the same plane. Moreover, on the lower surface sides of the forward and rearward extensions 23, 24 and the left and right extensions 25, 26, multiple recess groove portions 10*c* (or protruding portions), which are parallel to the longitudinal direction, is formed.

The monofilament 30 is fixed to such hook and loop fastener parts 10 by the block-shaped first fixing parts 21. The connection part 31 for connecting adjacent hook and loop fastener parts 10 is configured by the portion of the monofilament 30 which is interposed between the first fixing part 21 disposed at the far forward position of each hook and loop fastener part 10 and the first fixing part 21 disposed at the far rearward position of the hook and loop fastener 10 which is adjacent to the forward side of the same.

Figure 4A:
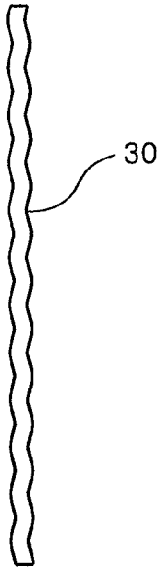
FIG. 4(*a*) is a front view illustrating a connection member, and FIG. 4(*b*) is a side view of the connection member.
Figure 4B:
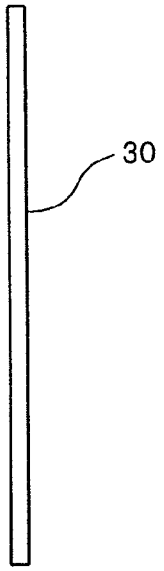
Figure 5:
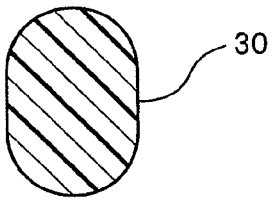
FIG. 5 is a cross sectional view of the connection member.

Here, the monofilament 30 in the embodiment is made of a thermoplastic resin, such as polyester, and has a flexibility. Moreover, as illustrated in FIGS. 4(*a*) and 4(*b*) which show only a front view and a side view of the monofilament 30, this monofilament 30 does not bend in the vertical direction, and linearly extends in the front and rear direction straightly, but is configured to be bent in a zig-zag shape in the left and right direction. Particularly, the bending interval of the monofilament 30 is set so as to dispose at least two bent portions having different bending directions between the first fixing parts 21 which constitute the connection part 31.

Figure 6A:
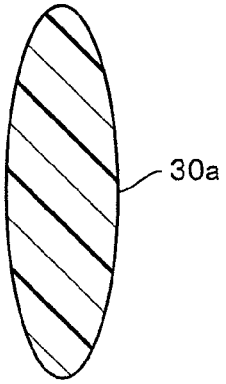
FIG. 6A and FIG. 6B, collectively referred to as FIG. 6 are cross sectional views illustrating modified examples of the connection member.
Figure 6B:
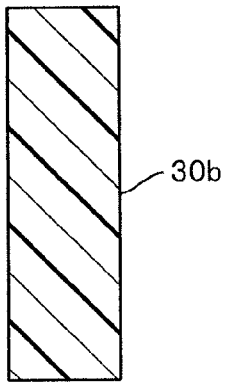

Further, the lateral cross section of the monofilament 30 has an elliptical shape whose major axis extends in the front and back direction of the backing 11 so as to be oriented along the vertical direction. Note that, in the invention, the lateral cross sectional shape of the monofilament 30 is not specifically limited, but is applicable as long as the molded hook and loop fastener 1 is designed so as to be more easily bent in the width direction than in the vertical direction at the connection part 31. For example, as illustrated in FIG. 6(*a*), a monofilament 30*a* having a lateral cross section of an elliptical shape which is further elongated in the vertical direction than the embodiment, or as illustrated in FIG. 6(*b*), a monofilament 30*b* having a lateral cross section of a rectangular shape whose long side extends in the vertical direction so as to be oriented along the vertical direction, may be used.

The monofilament 30 constituting the connection part 31 has a configuration as mentioned above, and therefore the molded hook and loop fastener 1 can be easily bent in the width direction at the connection part 31. Particularly, in the case of the embodiment, the forward and rearward extensions 23, 24 are disposed at all of the hook and loop fastener parts 10, and therefore the first fixing parts 21 are positioned at the inside with respect to the front end edge and the rear end edge of the hook and loop fastener part 10. Accordingly, the dimension L1 in the longitudinal direction of the connection part 31, which is disposed between the first fixing parts 21, is formed to be longer than the minimum space L2 between adjacent hook and loop fastener parts 10 when the molded hook and loop fastener 1 is held in a linear shape (namely, the distance between the parallel portion 10*a* at the front end edge of the hook and loop fastener part 10 and the parallel portion 10*a* at the rear end edge of the adjacent hook and loop fastener part 10).

Figure 7:
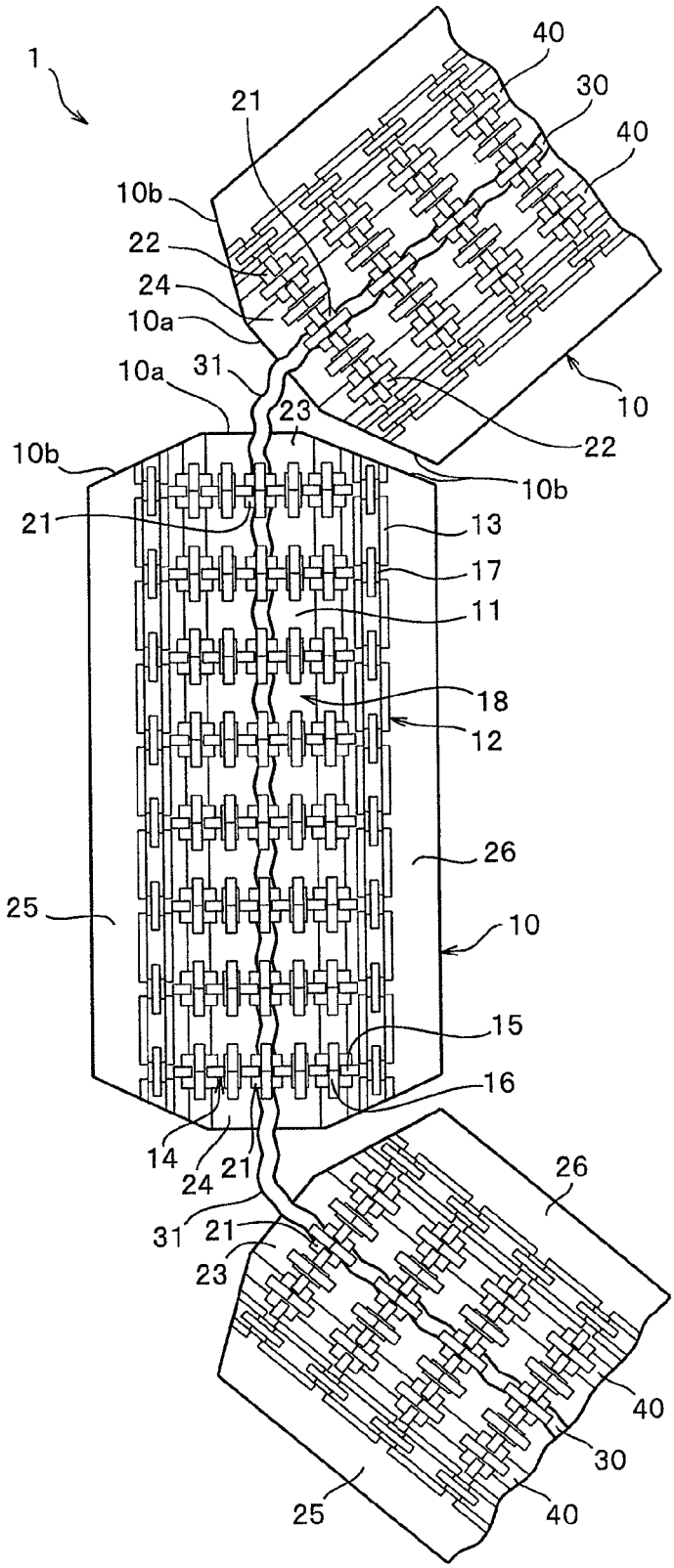
FIG. 7 is a front view illustrating a state in which the molded hook and loop fastener is bent in the width direction.
Figure 8:
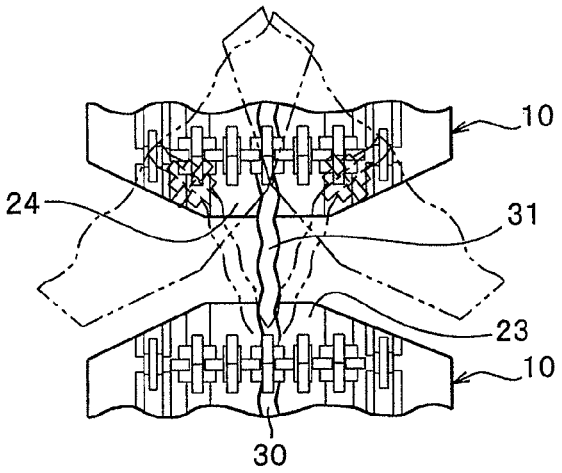
FIG. 8 is an explanatory diagram illustrating bending conditions of the molded hook and loop fastener.

Therefore, as illustrated in FIG. 7 and FIG. 8, by bending the connection part 31, the molded hook and loop fastener 1 according to the embodiment can bent in the left and right direction easier than, for example, the molded hook and loop fastener 70 which is described in above-mentioned Patent Document 1, and further the molded hook and loop fastener 1 can be bent with a larger curvature. Specifically, the molded hook and loop fastener 1 of the embodiment can be bent such that the radius of curvature becomes 80 mm, although it varies depending on the size of the molded hook and loop fastener 1.

The linear magnetic bodies 40 in the embodiment are disposed on the upper surface side of the backing 11 in the region of the hook and loop fastener part 10 along the rows of the engaging elements 16 which are disposed most adjacent to the left and right longitudinal protective walls 12, and are fixed to the hook and loop fastener part 10 via the second fixing parts 22. This linear magnetic body 40 has a circular cross section, and is configured by a material which is magnetically attracted, or a material which magnetically attracts. Particularly, it is desired that the linear magnetic body 40 is made by a material which is softer than the material of the molded hook and loop fastener part 10.

In this case, as the material of the linear magnetic body 40 which is magnetically attracted, the monofilament 30 which is prepared by mixing magnetic particles made of alloys of iron, cobalt, nickel and the like, into a synthetic resin such as polyester, or a metal twisted yarn which is made by twisting a few metal thin wires made of these alloys, may be used. On the other hand, as the material of the linear magnetic body 40 which magnetically attracts, a magnetized wire material, specifically a metal linear magnet, or a linear rubber magnet which is magnetized by mixing a magnetic iron oxide into a rubber, may be used. Moreover, in the invention, instead of the linear magnetic body, a thin tape-shaped magnetic body can be used.

The molded hook and loop fastener 1 according to the embodiment, which is provided with the configuration as mentioned above, is manufactured by means of, for example, a following manufacturing apparatus.

Specifically, the manufacturing apparatus of the molded hook and loop fastener 1, which is not shown, comprises a die wheel which is driven to rotate in one direction, a continuous extrusion nozzle for molten resin which is disposed so as to be opposite to the circumferential surface of the die wheel, a pick-up roll which is disposed downstream of the continuous extrusion nozzle in the rotational direction of the die wheel so as to be opposite to the circumferential surface of the die wheel, a monofilament supply portion which is disposed upstream of the continuous extrusion nozzle in the rotational direction of the die wheel for introducing the monofilament 30 into the space between the opposed surfaces of the die wheel and the continuous extrusion nozzle, a linear magnetic body supply portion for introducing the linear magnetic body 40 into the space between the opposed surfaces of the die wheel and the continuous extrusion nozzle, and a cutting portion for cutting the long hook and loop fastener member which has been torn off from the circumferential surface of the die wheel (hereafter referred to as a "primary hook and loop fastener member") at a predetermined portion of the primary hook and loop fastener member.

At the circumferential surface of the die wheel which is provided to the manufacturing apparatus, molding cavities for molding the engaging elements 16, the longitudinal protective walls 12, and the lateral walls 15 of the molded hook and loop fastener 1, are formed. Moreover, cooling liquid circulates in the die wheel, and a cooling liquid vessel is disposed under the die wheel such that the lower half portion of the die wheel is immersed in the cooling liquid.

When manufacturing the molded hook and loop fastener 1 according to the embodiment by using such a manufacturing apparatus, first, a molten resin material is continuously extruded from the continuous extrusion nozzle toward the circumferential surface of the die wheel. At this time, the die wheel is driven to rotate in one direction, the molten resin, which has been extruded onto the circumferential surface, forms the backings 11 and the like of the molded hook and loop fastener 1 between the continuous extrusion nozzle and the die wheel, and at the same time sequentially forms the engaging elements 16, the longitudinal protective walls 12, and the lateral walls 15 in the molding cavities mentioned above.

Moreover, at the same time when the molten resin material is extruded from the continuous extrusion nozzle, the zig-zag-shaped monofilament 30 and the linear magnetic bodies 40 are supplied to the extrusion position of the molten resin from the respective supply portions so as to be integrally formed into the primary hook and loop fastener member mentioned above.

The primary hook and loop fastener member, which is molded on the circumferential surface of the die wheel, is carried on the circumferential surface of the die wheel, and makes a half turn while being cooled so as to be solidified. After that, the primary hook and loop fastener member is continuously torn off from the circumferential surface of the die wheel by the pick-up roll.

Next, the primary hook and loop fastener member, which has been torn off from the die wheel, is conveyed toward the cutting portion, and at the cutting portion a predetermined area of the primary hook and loop fastener member other than the monofilament 30 is cut and removed such that the forward and rearward extensions 23, 24 of the hook and loop fastener part 10 are formed with a predetermined length. Specifically, a portion of predetermined area in the longitudinal direction including the lateral protective walls in the primary hook and loop fastener member is cut and removed entirely over the width direction other than the monofilament 30. With this, the molded hook and loop fastener 1 according to the embodiment as illustrated in FIG. 1 is manufactured. Note that, in the invention, the manufacturing apparatus and the manufacturing method for the molded hook and loop fastener 1 are not specifically limited, and can be optionally modified.

Thus obtained molded hook and loop fastener 1 of the embodiment is, for example, integrally molded into the cushion body (foam body) for a seat of an automobile.

Specifically, first, the manufactured molded hook and loop fastener 1 is cut into a necessary length, and the cut molded hook and loop fastener 1 is rested on the cavity surface of the mold for molding the cushion body.

At this time, in the inside of the mold, a magnet is buried at the position corresponding to the position where the molded hook and loop fastener 1 is rested, and therefore when the molded hook and loop fastener 1 is rested such that the surface where the engaging elements 16 are formed becomes to be opposite to the cavity surface of the mold, due to the attractive force of the magnet, the linear magnetic bodies 40, which are disposed at the molded hook and loop fastener 1, are attracted so that the molded hook and loop fastener 1 is adsorbed and fixed to the cavity surface of the mold.

Figure 9:
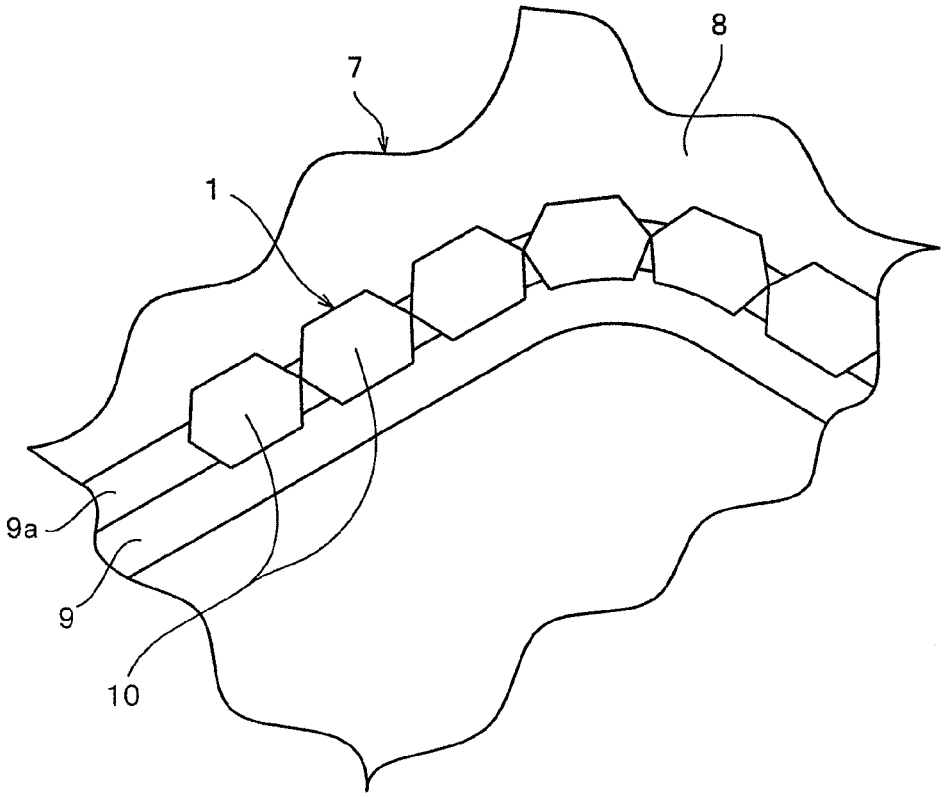
FIG. 9 is a schematic diagram illustrating a state in which the molded hook and loop fastener is adsorbed and fixed to a mold.
Figure 10:
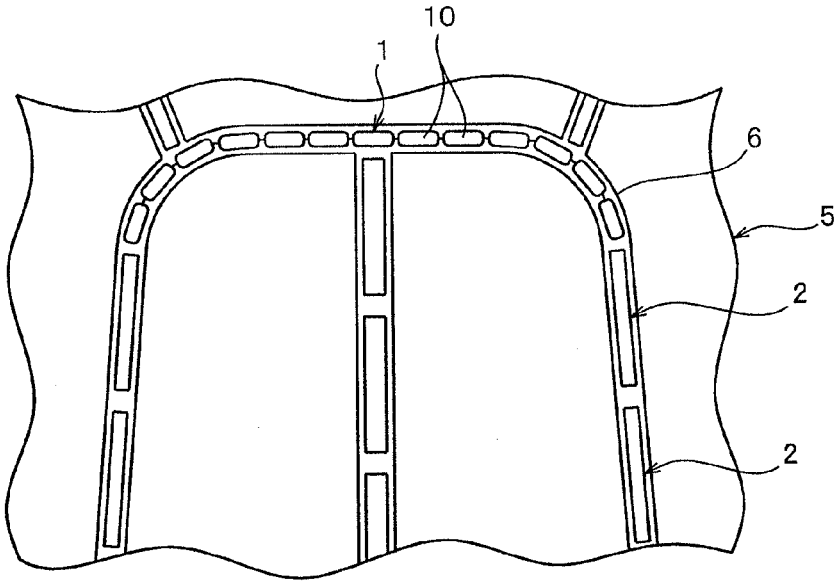
FIG. 10 is an enlarged view illustrating an essential part of a foam body into which the molded hook and loop fastener is integrated.
Figure 11:
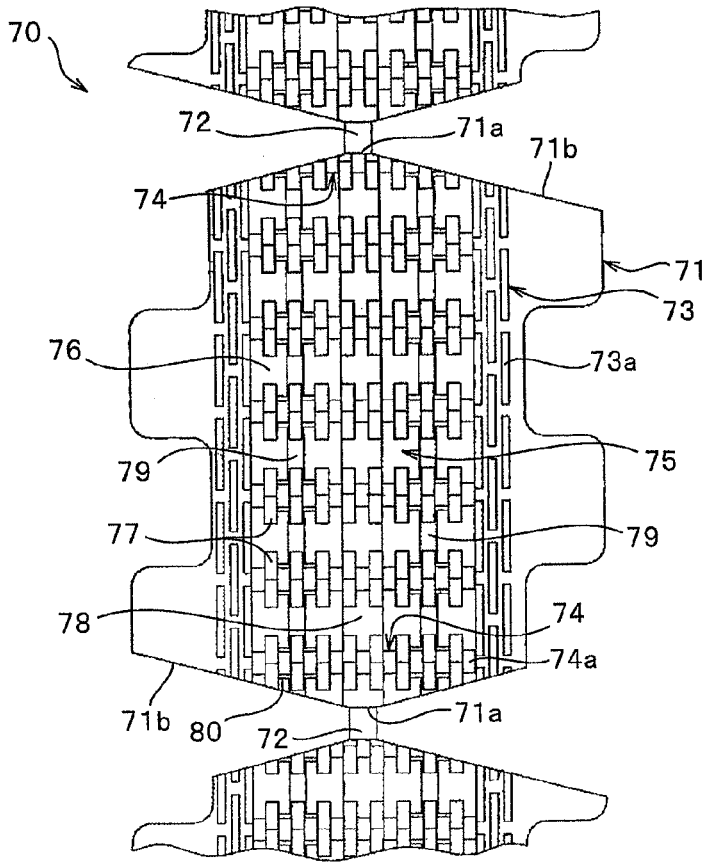
FIG. 11 is a front view illustrating a conventional molded hook and loop fastener.

Particularly, for example, as illustrated in FIG. 10, in the case that a recess 6 for the molded hook and loop fastener 1 is disposed at the cushion body 5, and the molded hook and loop fastener 1 is mounted and fixed to the inside of the recess 6, for example, as illustrated in FIG. 9, a protruding portion 9, which corresponds to the recess 6 of the cushion body 5, is formed at a cavity surface 8 of a mold 7, and the molded hook and loop fastener 1 is adsorbed and fixed to along the uniformly flat distal end surface (protruding surface) 9*a* of the protruding portion 9. At this time, the molded hook and loop fastener 1 is fixed to the protruding portion 9 in a state that the upper surfaces of the engaging elements 16, the longitudinal walls 13, and the lateral walls 15 of the hook and loop fastener part 10 are adhered to the protruding surface 9*a* of the protruding portion 9.

Moreover, as mentioned above, the molded hook and loop fastener 1 of the embodiment can be easily bent in the left and right width direction with a large curvature by bending the connection part 31, and therefore, even if the protruding portion 9 of the mold 7 is curved, or is formed so as to meander, the molded hook and loop fastener 1 can be stably fixed along the protruding surface 9*a* of the protruding portion 9 which is curved or meandered.

As mentioned above, after adsorbing and fixing the molded hook and loop fastener 1 of the embodiment to the mold 7 at a predetermined position, a foam resin material is sprayed and injected into the mold 7 from the spray nozzle. At this time, the foam resin material is sprayed while relatively moving the spray nozzle with respect to the mold 7, and therefore the foam resin material can be injected throughout the cavity space of the mold 7.

Further, in the molded hook and loop fastener 1 of the embodiment, as mentioned above, the forward and rearward extensions 23, 24 and the left and right extensions 25, 26 are configured at each hook and loop fastener part 10 so as to form the eaves with respect to the lateral protective walls 14 and the longitudinal protective walls 12. Therefore, even if the foam resin material is sprayed while the spray nozzle is relatively moved, the sprayed foam resin material is prevented from directly and vigorously hitting the lateral walls 15 and the longitudinal walls 13 of the hook and loop fastener part 10. As a result, the foam resin material can be effectively prevented from crossing over the lateral protective walls 14 and the longitudinal protective wall 12 so as to intrude into the engaging element forming region 18.

Then, after spraying a predetermined amount of foam resin material from the spray nozzle, the mold 7 is closed. With this, the foam resin material, which is foaming, reaches all through the cavity space of the mold 7 while flowing to the back surface (lower surface) of the molded hook and loop fastener 1, and the peripheries of the longitudinal protective walls 12 and the lateral protective walls 14, so as to mold the cushion body 5.

At this time, the molded hook and loop fastener 1 is positioned and fixed to the predetermined position by the adsorbing function of the magnet which is buried in the mold 7, and therefore the position of the molded hook and loop fastener 1 cannot be moved by the flow and foaming pressure of the foam resin material. Moreover, even if the foam resin material flowing in the cavity is about to intrude into the engaging element forming region 18 of the hook and loop fastener part 10, since the upper surfaces of the engaging elements 16, the longitudinal walls 13, and the lateral walls 15 of the hook and loop fastener part 10 are adhered to the protruding surface 9*a* of the protruding portion 9 which is disposed at the mold 7, the foam resin material is prevented from crossing over the lateral protective walls 14 and the longitudinal protective walls 12 so as to intrude into the engaging element forming region 18.

Note that, in the longitudinal protective walls 12 in the molded hook and loop fastener 1 of the embodiment, three row longitudinal walls 13*a* to 13*c* are disposed in a staggered manner so that the small spaces are formed between the respective longitudinal walls 13, and in the lateral protective walls 14, the small spaces are formed between the engaging elements 16 and the lateral walls 15. However, any of these spaces is very small, and therefore, even if the foam resin material flows into the spaces which are formed at the longitudinal protective walls 12 and the lateral protective walls 14 when foam molding, the foam resin material is cooled and solidified before intruding into the engaging element forming region 18. Therefore, the foam resin material never reaches the inside of the engaging element forming region 18 through the spaces of the longitudinal protective walls 12 and the lateral protective walls 14.

After that, when the foam resin material foams and is solidified so as to finish the molding, as illustrated in FIG. 10, the cushion body 5, to which the molded hook and loop fastener 1 of the embodiment is integrally molded along the curved recess 6, can be obtained. Note that, in this cushion body 5, although the linear molded hook and loop fastener 2, which is different from the embodiment, is also integrally molded along the linear recess 6 of the cushion body 5, in this invention, the molded hook and loop fastener 1 according to the embodiment can be mounted to such linear recess 6 of the cushion body 5.

Thus obtained cushion body 5 can stably ensure the planned and desired fastening force, which can be intrinsically obtained by the engaging elements 16, because the foam body has not intruded into the engaging element forming region 18 of the molded hook and loop fastener 1 which is integrated into the recess 6 on the surface.

Accordingly, by covering the surface of the obtained cushion body 5 with the epidermis material, and pressing the epidermis material toward the attachment position of the molded hook and loop fastener 1 in the cushion body 5, the female engaging elements disposed on the back surface of the epidermis material can be surely engaged with the engaging elements 16 (male engaging elements) of the molded hook and loop fastener 1. With this, the epidermis material can be precisely attached to the cushion body 5 closely along the curved surface of the surface of the cushion body 5 without making the epidermis material separated from the cushion body 5.

DESCRIPTION OF REFERENCE NUMERALS

1 molded hook and loop fastener
2 molded hook and loop fastener
5 cushion body
6 recess
7 mold
8 cavity surface
9 protruding portion
9*a* distal end surface (protruding surface)
10 hook and loop fastener part
10*a* parallel portion
10*b* inclined portion
10*c* recess groove portion
11 backing
12 longitudinal protective wall
13 longitudinal wall
13*a* first row longitudinal wall
13*b* second row longitudinal wall
13*c* third row longitudinal wall
14 lateral protective wall
15 lateral wall
16 engaging element
16*a* rising portion
16*b* engaging head portion
16*c* reinforcement portion
17 linkage portion
18 engaging element forming region
21 first fixing part
22 second fixing part
23 forward extension
24 rearward extension
25 left extension
26 right extension
30 monofilament
30*a* monofilament
30*b* monofilament
31 connection part
40 linear magnetic body
L1 dimension of connection member in the longitudinal direction
L2 minimum interval between adjacent hook and loop fastener parts

The invention claimed is:

1. A molded hook and loop fastener which is capable of being integrated into a surface of a foam body when the foam body is molded, comprising: multiple hook and loop fastener parts having backings whose first surfaces are provided with multiple engaging elements so as to stand on the first surfaces; and a connection member which has flexibility and connects the hook and loop fastener parts in a longitudinal direction, wherein the hook and loop fastener parts comprise left and right longitudinal protective walls which are disposed along the longitudinal direction of the backings so as to interpose the multiple engaging elements between the left and right longitudinal protective walls, lateral protective walls and fixing parts which are projected on the first surfaces of the backings and fix the connection member, the backings of all of the hook and loop fastener parts comprise forward and rearward extensions which extend in the longitudinal direction from positions where the fixing parts are disposed, and from which the engaging elements are excluded, the connection member comprises flexible monofilament which passes through a side of the lateral protective walls, a surface of the monofilament is exposed in the forward and rearward extensions, a dimension in the longitudinal direction of the connection member at a connection part, which is disposed between the fixing parts, and connects the hook and loop fastener parts, is set to be longer than a minimum interval between adjacent hook and loop fastener parts, and a lateral cross section of the connection member has an elliptical shape, whose major axis is extended along a front and back direction of the backings.

2. The molded hook and loop fastener according to claim 1, wherein the engaging elements are disposed to stand on the backings so as to be aligned in the longitudinal direction and a width direction of the backings, and multiple lateral walls which configure the lateral protective walls together with the engaging elements aligned in the width direction are disposed to stand along the width direction between the left and right longitudinal protective walls.

3. The molded hook and loop fastener according to claim 1, wherein each of dimensions in the longitudinal direction from a front end edge and a rear end edge of the forward and rearward extensions to the lateral walls are set to be 50% or more of a dimension of the engaging element in the longitudinal direction.

4. The molded hook and loop fastener according to claim 1, wherein the connection member comprises a zig-zag portion which is alternately bent to the other side of the backings in the width direction, and the zig-zag portion comprises at least two bent portions.

5. The molded hook and loop fastener according to claim 1, wherein opposed end edges of adjacent hook and loop fastener parts comprise parallel portions which are disposed so as to be parallel to each other, and inclined portions which are disposed on both left and right sides of the parallel portions so that an interval between the hook and loop fastener parts is gradually increased toward side end edges of the hook and loop fastener parts, and a width dimension of the parallel portion is set to be larger than a width dimension of the connection part.

* * * * *